US008320784B2

(12) United States Patent
Tombs et al.

(10) Patent No.: US 8,320,784 B2
(45) Date of Patent: Nov. 27, 2012

(54) ENHANCED FUSING OF RAISED TONER USING ELECTROGRAPHY

(75) Inventors: Thomas N. Tombs, Rochester, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 301 days.

(21) Appl. No.: 12/553,284

(22) Filed: Sep. 3, 2009

(65) Prior Publication Data

US 2011/0052234 A1 Mar. 3, 2011

(51) Int. Cl.
*G03G 15/20* (2006.01)

(52) U.S. Cl. ..... 399/68

(58) Field of Classification Search ..... 399/67, 399/68, 322

See application file for complete search history.

(56) References Cited

U.S. PATENT DOCUMENTS

| | | | | |
|---|---|---|---|---|
| 7,184,679 | B2 | 2/2007 | Wu et al. | |
| 2007/0274734 | A1 | 11/2007 | Kikuchi | |
| 2008/0143815 | A1* | 6/2008 | Emmert et al. | 347/251 |
| 2008/0159786 | A1* | 7/2008 | Tombs et al. | 399/222 |

FOREIGN PATENT DOCUMENTS

WO WO 2009/078948 A1 6/2009

* cited by examiner

*Primary Examiner* — Walter L Lindsay, Jr.
*Assistant Examiner* — Frederick Wenderoth

(57) ABSTRACT

Printing of information with a distinct tactile feel can be accomplished by electrographic techniques. Such electrographic printing includes electrographic printing of raised images to selected areas of a receiver member using electrographic techniques so that they are fixed according to the properties of the raised print such as according to the mass per unit area or toner height. In one embodiment, by slowing down the process speed of the fuser to allow for a longer dwell so that the large toner particles and/or toner mass needed to make raised image will properly adhere to the print media without artifacts. To keep the energy requirements and the cost of the equipment down a speed switching technique is used that slows the process speed of the fuser so that the raised image is properly fused on a wide range of paper types.

20 Claims, 8 Drawing Sheets

ENHANCED FUSING OF RAISED TONER USING ELECTROGRAPHY

FIELD OF THE INVENTION

This invention relates in general to printing and in particular to raised printing to generate a tactile feel using electrographic methods.

BACKGROUND OF THE INVENTION

One common method for printing images on a receiver member is referred to as electrography. In a particular implementation of this method, known as electrophotography, an electrostatic image is formed on a dielectric member by uniformly charging the dielectric member and then discharging selected areas of the uniform charge to yield an image-wise electrostatic charge pattern. Such discharge is typically accomplished by exposing the uniformly charged dielectric member to actinic radiation provided by selectively activating particular light sources in an LED array or a laser device directed at the dielectric member. After the image-wise charge pattern is formed, the pigmented (or in some instances, non-pigmented) toner particles are given a charge, substantially opposite the charge pattern on the dielectric member and brought into the vicinity of the dielectric member so as to be attracted to the image-wise charge pattern to develop such pattern into a visible image.

Thereafter, a suitable receiver member, sometimes simply referred to as a receiver, (e.g., a cut sheet of plain bond paper) or an intermediate transfer member, sometimes simply referred to as an intermediate, (e.g. a compliant or non-compliant roller or web) is brought into juxtaposition with the marking particle developed image-wise charge pattern on the dielectric member. A suitable electric field is applied to transfer the marking particles to the receiver member in the image-wise pattern to form the desired print image on the receiver or intermediate transfer member. In the case of an intermediate transfer member, a secondary transfer step is performed whereby a second suitable electric field is applied to transfer the marking particles from the intermediate receiver member to the receiver member. The receiver member is then removed from its operative association with the dielectric member and the marking particle print image is permanently fixed to the receiver member typically using heat, and/or pressure. Multiple layers or marking materials can be overlaid on one receiver, for example layers of different color particles can be overlaid on one receiver member to form a multi-color print image on the receiver member after fixing.

In order to print the images with raised areas, such as text and graphics, for a tactile effect, such as printing using a larger toner particle to increase the height of the printed image, it is necessary to adjust the fusing and printing parameters that are related to the properties of the raised print to enhance the print quality and meet customer expectations. For example, the resulting increase in toner mass requires higher fusing temperatures and/or pressures to properly fix the image to the print media. A fusing system that can achieve higher fusing setpoints inevitably costs more and utilizes more energy. This invention enables printing of raised images on high speed EP devices and also enables printing raised images on low cost equipment with low energy requirements.

SUMMARY OF THE INVENTION

With the improved print image quality, print providers and customers alike have been looking at ways to expand the use of electrographically produced prints. In certain classes of printing, a tactile feel to the print is considered to be highly desirable. Specifically, ultra-high quality printing, such as printing for stationary headers or business cards, utilizes raised letter printing to give a tactile feel to the resultant print output. For many of these printing applications, in order to directly replace the standard, and more expensive, engraving, embossing, or thermographic processes, it is highly desirable to produce a raised letter height of 50 μm or greater and or to have a mass per unit density greater then 2.5 mg/cm2. Some other instances where tactile feel in the print would be desirable are Braille prints or print documents having security features provided there within. Presently, the minimum height recommended for Braille prints is 200 μm which may use a mass per unit density greater then 10.0 mg/cm2.

U.S. Patent Application Publication No. 2008/0159786 describes the use of a fifth color module in an electrophotographic printing process for depositing a high mass laydown ($\geqq 2$ mg/cm$^2$) of a large clear toner particle alongside standard, smaller sized, pigmented toner particles for producing a high quality print having tactile feel. However, due to limitations on: 1) toner size due to the manufacturing process—typical processes limit toner size average diameter to roughly 30 μm, and 2) the development step in the electrophotographic process —limiting the mass laydown to roughly a double layer of clear toner, the maximum raised letter height for a rich black text at 320% laydown for 8-9 μm (0.5 mg/cm2) pigmented toner plus the large clear toner is less than 35-40 μm (4 mg/cm2 for clear alone). This falls short of the 50 μm (5.5 mg/cm2 mass per unit area) for the height desired for directly replacing thermographically produced prints and falls far short of the 200 μm (10.0 mg/cm2) recommended height for Braille prints. In addition, achieving a ground toner size of 30 μm or greater creates significant manufacturing challenges and costs: 1) changing to a non-standard air nozzle for grinding—manufacturing inefficiency, and 2) extra size classifying step—significantly lower manufacturing yield.

Accordingly, the invention is directed to an electrographic printing of raised images to selected areas of a receiver member using electrographic techniques so that they are fixed according to the properties of the raised print such as according to the mass per unit area or toner height. In one embodiment, by slowing down the process speed of the fuser to allow for a longer dwell so that the large toner particles and/or toner mass needed to make raised image will properly adhere to the print media without artifacts. To keep the energy requirements and the cost of the equipment down a speed switching technique is used that slows the process speed of the fuser so that the raised image is properly fused on a wide range of paper types.

DETAILED DESCRIPTION OF THE INVENTION

Figure 1:
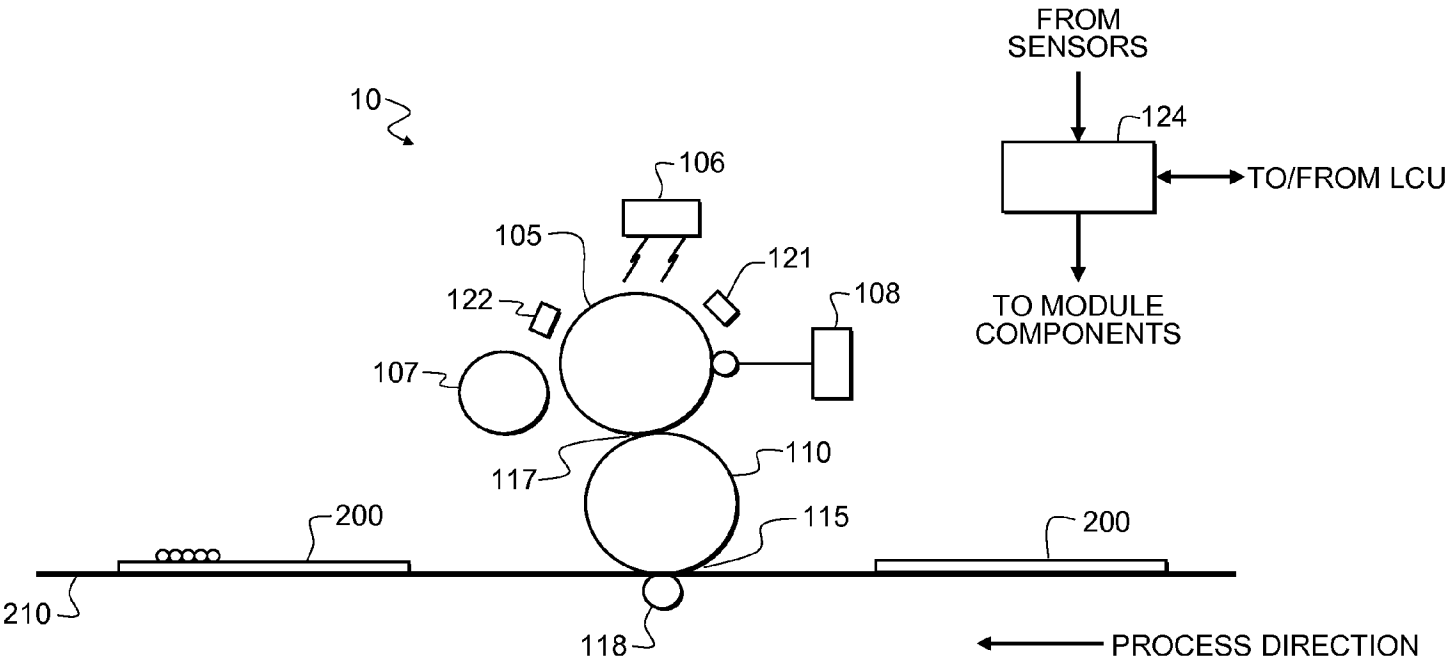
FIG. 1 is a schematic diagram illustrating an electrographic printing module for use with the present invention.
Figure 2:
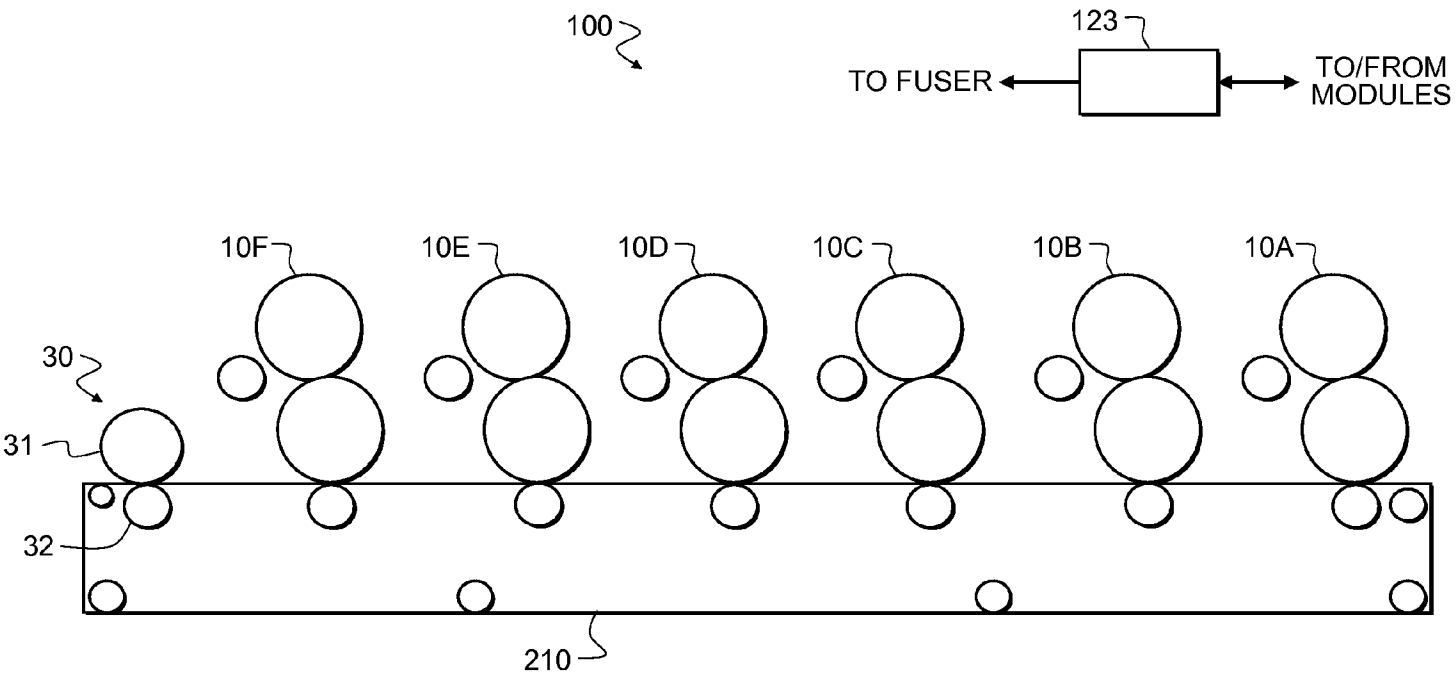
FIG. 2 is a schematic diagram illustrating an electrographic printing engine employing printing modules as illustrated in FIG. 1 for use with the present invention.

Referring now to the accompanying drawings, FIGS. 1 and 2 schematically illustrate an electrographic printer engine according to embodiments of the current invention. Although the illustrated embodiment of the invention involves an electrographic apparatus employing six image producing print modules arranged therein for printing onto individual receiver members, the invention can be employed with either fewer or more than six modules. The invention may be practiced with other types of electrographic modules.

The electrographic printer engine 100 has a series of electrographic printing modules 10A, 10B, 10C, 10D, 10E, and 10F. As discussed below, each of the printing modules forms an electrostatic image, employs a developer having a carrier and toner particles to develop the electrostatic image, and transfers a developed image to a receiver member 200. Where the toner particles of the developer are pigmented, the toner particles are also referred to as "marking particles." The receiver member may be a sheet of paper, cardboard, plastic, or other material to which it is desired to print an image or a predefined pattern.

The electrographic printing module 10 shown in FIG. 1 is representative of each of the electrographic printing modules 10A-10F of the electrographic printing engine 100 shown in FIG. 2. The electrographic printing module 10 includes a plurality of electrophotographic imaging subsystems for producing one or more multilayered image or shape. Included in each printing module is a primary charging subsystem 108 for uniformly electrostatically charging a surface of a photoconductive imaging member (shown in the form of an imaging cylinder 105). An exposure subsystem 106 is provided for image-wise modulating the uniform electrostatic charge by exposing the photoconductive imaging member to form a latent electrostatic multi-layer (separation) image of the respective layers. A development station subsystem 107 is provided developing the image-wise exposed photoconductive imaging member. An intermediate transfer member 110 is provided for transferring the respective layer (separation) image from the photoconductive imaging member through a first transfer nip 117 to the surface of the intermediate transfer member 110 and from the intermediate transfer member 110 through a second transfer nip 115 to a receiver member 200.

The electrographic printing engine illustrated in FIG. 2 employs six electrostatic printer modules 10A, 10B, 10C, 10D, 10E, and 10F each of which has the structure of the electrostatic printer module 10 illustrated in FIG. 1.

Each of the printing modules is capable of applying a single color, transferable image to receiver members 200. The transport belt 210 transports the receiver member 200 for processing by the printing engine 100. As the receiver member 200 moves sequentially through the printing nips of the electrostatic printer modules 10A, 10B, 10C, 10D, 10E, and 10F, the printing modules successively transfer the generated, developed images onto the receiving member in a single pass.

The illustrated printing engine 100 includes six electrostatic printing modules, and accordingly up to six images can be formed on a receiver member in one pass. For example, printing modules 10A, 10B, 10C, and 10D can be driven with image information to form black, yellow, magenta, and cyan, images, respectively. As is known in the art, a spectrum of colors can be produced by combining the primary colors cyan, magenta, yellow, and black, and subsets thereof in various combinations. The developer employed in the development station of printing modules 10A, 10B, 10C, and 10D would employ pigmented marking particles of the respective color corresponding to the color of the image to be applied by a respective printing module. The remaining two modules, 10E and 10F, can be provided with marking particles having alternate colors to provide improved color gamut, non-pigmented particles to provide clear layer protection or raised print capability, or some combination thereof. For example, the fifth electrostatic module can be provided with developer having red pigmented marking particles and the sixth electrostatic module can be provided with developer having larger sized non-pigmented particles.

Following the completion of the transfer step by a plurality of the electrostatic printing modules 10A-10F in sequence for a given receiver member, a fusing step is performed on the receiver member to fuse the multi-color developed image to the receiver member. The fusing step provides heat and/or pressure to the receiver member.

For example, the transport belt 210 can move the receiver member 200 with the multi-colored image to fusing assembly 30. Fusing assembly 30 includes a heated fusing roller 31 and an opposing pressure roller 32 that form a fusing nip therebetween to apply heat and pressure to a receiver member 200. The fusing assembly may also apply fusing oil such as silicone oil to the fusing roller 31 depending on the application. Additional details of the developing and fusing process are described in U.S. Publication No. 2008/0159786, published Jul. 3, 2008 in the names of Thomas N. Tombs, et al. which is herein incorporated by reference.

In the example shown, the same transport belt 210 is used for transferring the receiver members 200 through the printing modules and for moving the receiver members 200 through the fusing step so that the process speed for fusing and the process speed for applying raised and print images are the same. The invention is not limited to practice with a single process speed, and separate transport mechanisms can be provided for applying images and fusing images allowing the image applying and fusing process speeds to be set independently.

The printing engine 100 includes a logic and control unit 123 that includes one or more computers and in response to signals from various sensors associated with the electrographic printer engine 100, provides timing and control signals to the respective components to provide control of the various components and process control parameters of the apparatus in accordance with well understood and known employments. The logic and control unit 123 may contain individual logic and control components 124 for each of the printing modules 10A, 10B, 10C, 10D, 10E, and 10F. This control system allows control of the fuser and paper path speed as well as all related setpoints that effect the printing and fusing of raised prints, also referred to as fixing of raised prints or raised images.

According to principles of the present invention, the process for printing the raised information and enhancing the fusing of this raised toner, and/or the process printing parameters are adjusted, thus effectively slowing down the process speed of the fuser to allow for a longer dwell so that the large toner particles and/or toner mass needed to make raised images will properly adhere to the print media without artifacts. In one embodiment described below a speed switching technique is used to slow down the process speed of the fuser (and the EP process in some embodiments) so that the raised image is properly fused on a wide range of paper types. This slow down can be handled by automatically slowing down the printing speed for the entire job and/or alternatively, when the printer detects the presence of dry-ink station containing toner that enables raised printing it changes modes so that it prints at a slower speed. In other embodiments the printer changes the appropriate fusing and EP set-points that are optimum for printing at the new speed. These set points include one or all of the following including those that control the fusing setpoints, writing setpoints for writing the image, paper feeding related setpoints, toner feeding and mixing apparatus related setpoints and controlling the photoconductor and related aspects of printing related setpoints.

By adjusting these setpoints and automatically switching the speeds of paper flow of the receiver through the fusing system, using this invention, prints were made with raised images up to 30 um in height on 300 gsm paper at 83 ppm on a NexPress printing press. However, when attempting to fuse at higher speeds fusing artifacts (cold offset) were generated even though the fuser was set to its highest practical temperature and pressure. Using the enhanced method described below the printer was also able to print raised images up to 50 um in height on 300 gsm paper at 70 ppm but when attempting to fuse at higher speeds fusing artifacts (cold offset)) occurred even though the fuser is set to its highest practical temperature and pressure.

For the purpose of providing selective printing of raised printed information using an electrographic printing apparatus, for example for the purpose of generating a tactile feel, printed images can be generated using one or more of printing modules of the print engine with pigmented marking particles, and selected electrostatic printing modules of the printing engine can be provided with non-pigmented, non-marking particles (e.g. clear toner). By printing non-marking particles on top of a print image formed using marking particles, raised print information, for example raised lettering can be applied to a receiver member.

The term particle size, as used herein to refer to developer particles including the carrier, marking and non-marking particles means the mean volume weighted diameter as measured by conventional diameter measuring devices, such as a Coulter Multisizer, sold by Coulter, Inc. The mean volume weighted diameter is the sum of the mass of each particle times the diameter of a spherical particle of equal mass and density, divided by total particle mass.

The principle employed in providing tactile feel is to achieve a post fusing stack height of at least 20 μm, this can in certain environments be created from a toner laydown of around 2.3 mg/cm2 on a receiver member. The amount of laydown that can achieve some of the heights mentioned below are indicated following the heights mentioned below with the understanding that these are based on the one embodiment described and could vary if the printing conditions changed from those described. However, 40 to 50 μm (5.5 mg/cm2) and greater stack heights are often desirable for some applications, and in some cases even greater stack heights including heights created from toner laydown of 10 mg/cm2 and more are required.

With a typical electrographic printing module, developing steps using two component developer systems are limited to applying two layers of toner particles due to counter charge issues. The resulting stack height after fusing a single layer of 8-9 μm (0.5 mg/cm2) marking particles is about half that (4 μm). Building up the stack height could be accomplished by using several printing modules to build up layers of toner particles. But increasing the stack height using standard sized particles would limit the number of printing modules available for depositing pigmented color modules. Accordingly, particles substantially larger than 8-9 μm (0.5 mg/cm2) are employed to provide raised printing having post fusing stack heights greater than 20 μm.

Techniques for employing developers having toner particles of greater than 20 μm can be used to provide raised printing. Typically electrographic printing modules employing such particles can apply two layers per module whereby the 2 layers of 20 μm (2.3 mg/cm2) particles produce a post fusing stack height of about 20 μm (2.3 mg/cm2).

According to principles of the present invention, a print image can be transferred to a receiver member using one or more of the available electrographic print modules in a single pass. To form a print image having the highest quality, the print image can be formed using a layer of small, pigmented marking particles having a standard, general volume average diameter of less than 8-9 μm (0.5 mg/cm2).

The print image can be a multi-colored print image formed by using a plurality of electrographic print modules. Referring to FIG. 2, by using electrographic print engine 100, electrographic print module 10A can form yellow (Y) toner separation images, electrographic print module 10B can form magenta (M) toner separation images, 10C can form cyan (C) toner separation images, while 10D can form black (K) toner separation images. While the use of C, Y, M, and K images allows generation of a print image having a spectrum of colors the invention may be practiced using other colors.

The electrographic printing modules 10A, 10B, 10C, and 10D are controlled using electrographic process-set points, control parameters, and algorithms appropriate for the developer for printing using the marking particles and carrier particles of the print image. The set-points, control parameters, and algorithms can be implemented in logic forming part of the logic and control unit 123.

After electrographic printing modules 10A, 10B, 10C, and 10D have been used to deliver the multi-color portion of the print image to the receiver member 200, a plurality of remaining modules can be used to form raised images on selected areas of the receiver member 200. By employing multiple printing modules to apply raised images to the receiver member in a single pass, a final stack height can be obtained for providing the required tactile feel.

Figure 3:
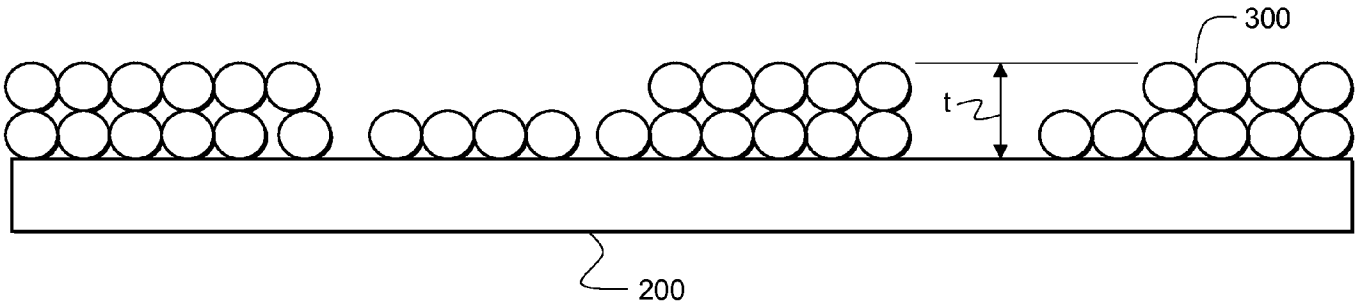
FIG. 3 is a schematic side view illustrating a cross section of a receiver member having a print image formed thereon.

FIG. 3 shows a receiver member 200 having a print image 300 formed using print modules 10A, 10B, 10C, and 10D. As shown in FIG. 3, the print image has a stack height "t." Where 8-9 μm (0.5 mg/cm2) marking particles are used, the print image stack height can be between 4 and 8 μm after the fusing process.

The development stations for electrographic printing modules 10E and 10F supply developer that includes carrier particles and non-pigmented non-marking particles. The non-marking particles used in forming the raised images are substantially larger in size than the standard sized marking particles used in forming the print image. For example, the volume average diameter of the non-pigmented toner particles may be between greater than 14 μm, and preferably between 20 μm (2.3 mg/cm2 mass per unit area) and 50 μm (5.5 mg/cm2 mass per unit area), and more preferably between 20 μm (2.3 mg/cm2 mass per unit area) and 30 μm (4.0 mg/cm2 mass per unit area) μm.

Figure 4:
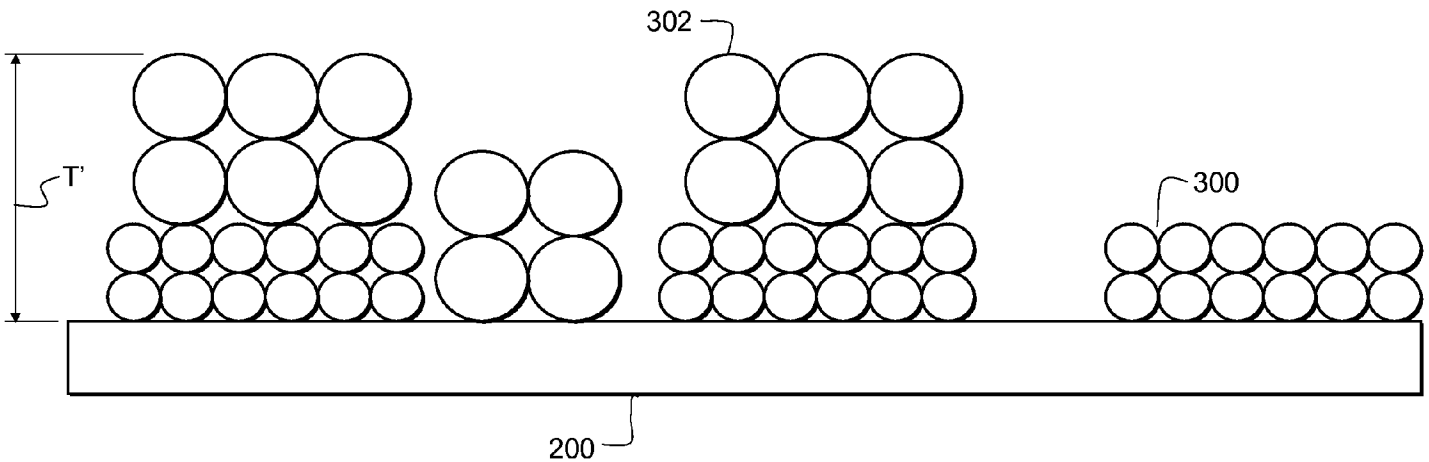
FIG. 4 is a schematic side view illustrating a cross section of a receiver member having a first raised image formed thereon.

Using printing module 10E, the printing engine 100 forms a first raised image. Referring to FIG. 4, it may be appreciated that the first raised image 302 is formed in selected areas of the receiver member 200 on which the printed image 300 has been formed. The selected areas for forming the first raised image 302 can include areas that overlap areas having marking particles from the print image 300, but can also be formed in areas where no marking particles for the first print image are disposed.

Figure 5:
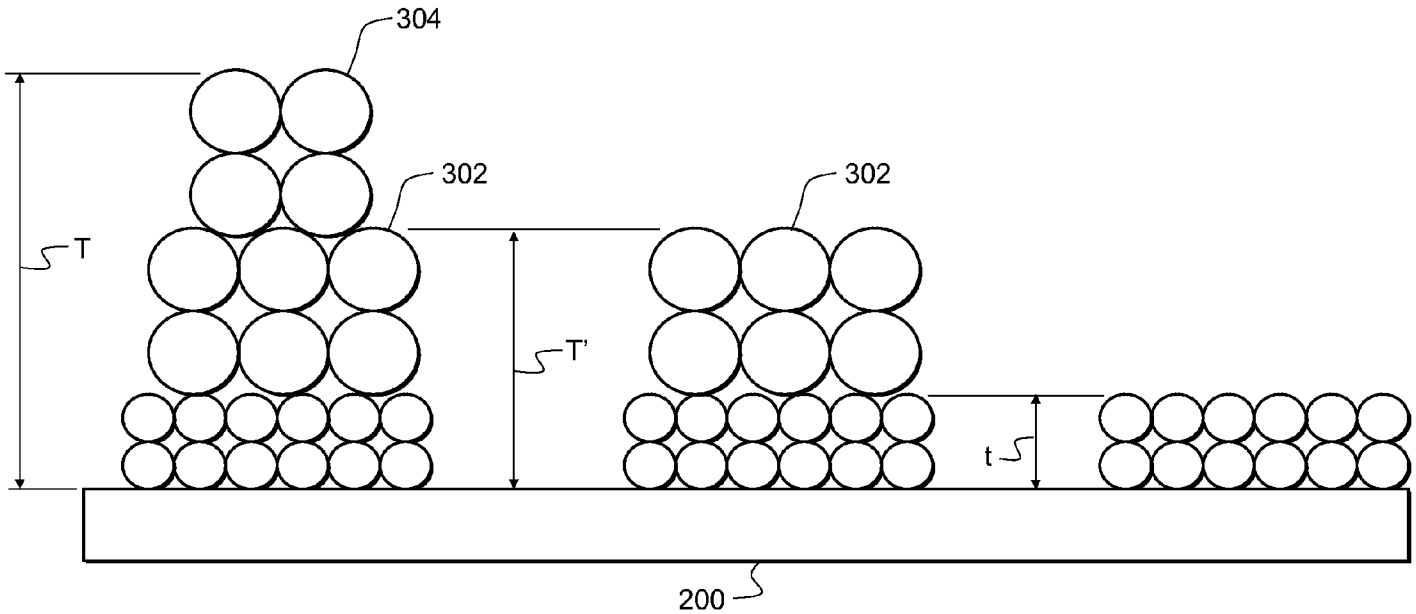
FIG. 5 is a schematic side view illustrating a cross section of a receiver member having a second raised image formed thereon.

Next, the printing engine 100 forms a second raised image using printing module 10F. Referring to FIG. 5, it may be appreciated that the second raised image 304 is formed in second selected areas of the receiver member 200 on which the printed image 300 and the first raised image has been formed. The second selected areas for forming the second raised image 304 can include areas that overlap areas having marking particles from the first raised print image 302, but can also be formed in areas of the receiver member where no marking particles for the first print image are present and areas in which no marking particles for the first raised image are present.

Where the second raised image 304 overlaps with the first raised image 302 and the print image, a desired stack height T for achieving the desired tactile feel can be obtained, whereas in those areas where only one of the first and second raised images is applied, a lesser stack height T' is obtained. Using the larger non-marking particles for generating the larger portion of the desired stack height achieves larger stack heights while reserving an adequate number of printing modules for applying a print image. Further, using the smaller marking particles for applying the print image allows a high quality print image even when clear, raised, images are printed on the print image. In addition, using small size marking particles for image areas where the raised effect is not needed and large non-marking particles for areas where the raised effect is desired enables the ability to simultaneously produce a raised image and a non-raised image. Finally, the use of small size marking particles for image areas where the raised effect is not needed minimizes the cost of producing the print since less mass is required when smaller marking particles are utilized.

In other embodiments of the invention, a multi-colored print image may be applied to the print receiver using fewer than four print modules. Referring to FIG. 2, electrographic print module 10A can form yellow (Y) toner separation images, electrographic print module 10B can form magenta (M) toner separation images, while 10C can form a cyan (C) toner separation images. When printing a multi-colored image using yellow, magenta, and cyan, images, black color may be generated by applying equal amounts of yellow, magenta, and cyan in the desired area of the print image. In this case, three printing modules, namely, modules 10D, 10E, and 10F are available for forming raised images on selected areas of the receiver. In yet another embodiment, a single print module can apply a monochromatic or gray scale print image to the receiver member using standard sized marking particles. For example, using a single print module of print engine 100 to apply a monochromatic print image reserves five modules for applying raised images. For example, after the printing engine 100 forms a single color print image on the receiver member 200 using print module 10A, a plurality of the remaining modules are available for forming raised images on the receiver member 200. Using the print engine illustrated in FIG. 2, two, three, four, or five raised images may be formed in succession on a receiver member using two or more of printing modules 10B, 10C, 10D, 10E, and 10F, enabling raised post fusing print heights well in excess of 100 μm.

Image data for writing by the printer apparatus 100 may be processed by a raster image processor (RIP), which may include a color separation screen generator or generators. The output of the RIP may be stored in frame or line buffers for transmission of the color separation print data to the exposure units of each of the respective print modules used for applying the print image. The RIP and/or color separation screen generator may be a part of the printer apparatus or remote therefrom. Image data processed by the RIP may be obtained from a color document scanner or a digital camera or generated by a computer or from a memory or network which typically includes image data representing a continuous image that needs to be reprocessed into halftone image data in order to be adequately represented by the printer. The RIP may perform image processing processes including color correction, etc. in order to obtain the desired color print. Color image data is separated into the respective colors and converted by the RIP to halftone dot image data in the respective color using matrices, which comprise desired screen angles and screen rulings. The RIP may be a suitably programmed computer and/or logic devices and is adapted to employ stored or generated matrices and templates for processing separated color image data into rendered image data in the form of halftone information suitable for printing.

In areas where one or more raised images overlap a colored print image, the apparent color of the print image as viewed through the raised image may change. In order to produce a finished printed product in which colors appear consistently across a receiver member, the algorithm for generating the color separation include a color profile that generates a different color separation in areas where the print image is overlapped by a raised image than in areas where the print image is not overlapped by a raised image. In one embodiment, two color profiles are created. The first color profile is for 100% clear or non-pigmented toner coverage on top, and the second color profile is for 0% clear toner coverage on top. On a pixel by pixel basis, proportional to the amount of coverage called for in the clear toner image plane, a third color profile is created, and this third color profile interpolates the values of the first and second color profiles. Thus, a blending operation of the two color profiles is used to create printing values. In a preferred embodiment, a linear interpolation of the two color profile values corresponding to a particular pixel is performed. It is understood, however, that some form of nonlinear interpolation may be used instead.

A clear toner overcoat can be provided in areas of the receiver member where raised printing is not desired. One method of enhancing fusing is to provide good adhesion to a receiver member when there is a large variation in toner mass laydown on a receiver member. The described method includes the steps of forming multicolor toner images, determining the amount of clear overcoat mass laydown (OML) as a function of the color mass laydown (CML) or non-raised mass laydown (NRML) of one or more layers of color toner, and fusing the clear toner overcoat and the multicolor toner image at a fusing temperature determined by the maximum total mass laydown (TML) and the nip width to provide good adhesion to the receiver member while optimizing fuser offset latitude. It has been found that the deposition of a significantly less than 100% coverage of clear toner in the non-raised image areas, defined as the OML and significantly less than 2.0 mg/cm$^2$, can serve as a protective overcoat layer, pushing the hot offset failure to a higher temperature, thereby enhancing the fuser offset latitude and enabling the use of a high mass laydown of toner for a raised print application in all circumstances, for example when one or more receivers are of a dense or coated paper, which does not readily absorb oil. Essentially, the total toner mass laydown of the non-raised regions (the sum of the NRML and OML) is increased so as to avoid excessive heating and cohesive failure. Preferably, this coverage is in the range of 0% to 60%, the exact coverage depending upon the mass laydown of the non-clear toner (NRML) as well as other factors describing the fuser subsystem, the toner materials, and the receiver member. Note that in general the mass laydown per area of the protective overcoat layer (OML) is non-linear with % coverage, such that 50% coverage will be noticeably less than ½ of the mass laydown associated with 100% coverage. Another benefit of this protective layer is the reduction of the color shift observed between raised and non-raised image areas. The low coverage of clear toner in the non-raised image areas is still sufficient to reduce the toner flow in fusing, thereby resulting in more similar color shifts as observed in the raised image areas, the color shift being measured relative to a CMYK toner laydown without any protective layer.

The image data for printing the raised images may be developed in a number of ways. In one embodiment, the raised image data can be generated from the print image information to correspond to certain types of objects in the print image. For example, the raised image data may be generated to correspond to a text object so that the text object will be printed with raised printing. In this case a digital front end for the print module will generate data for driving the exposure units of the plurality of print modules used for applying the correspondingly numbered raised images to the receiver member. The raised image is applied to completely overlap the print image. In that case, data for the raised image information is again derived from the color or mono-chrome data for printing the print image, but is computed such that the raised image is applied in the entire area for applying the print image. For example, where a CYMK print image is applied, the raised information is generated to have a value for any pixel or area in which either a C, Y, M, or K image information as a non-zero value.

The raised data may be retrieved from a suitable database containing a pattern to enable the variable data printing of tactile images wherein the background texture may, for example, provide the impression of a painter's canvas, an acrylic painting, a basketball (pigskin), sandstone, sandpaper, cloth, carpet, parchment, skin, fur, or wood grain. The locations for applying the pattern can also be specified independently of the data for the print image so the texture may be applied in specific areas of the receiver members.

Although specific modules were described as providing the print image and the raised images in the examples below, the invention is not limited to being practiced in this manner. For example, the selected areas for applying the raised images may not overlap any areas for applying the print image. As another example, it may be desired to display a tactile image in portions of the receiver member that do not include the print image. In such a case, any sequence of modules can be used for applying the print image and the raised image.

On the other hand, in applications requiring raised printing such as raised text, a print image is applied to the receiver member in the areas requiring raised printing prior to applying the raised images. When applying the raised printing in a single pass, the modules selected for applying the raised printing are chosen to apply clear toner following the application of the print image.

Further, although the invention is described herein using an example printing engine having six print modules, the number of print modules is exemplary and the invention may be practiced with an apparatus having a different number of print modules.

Additionally, the developer for applying the raised images has been described as applying non-marking particles which are not pigmented. In an alternative embodiment, the developer for applying the raised images may contain pigmented toner particles having a size substantially larger than the marking particles for applying the print image.

When printing the raised images using a substantially larger size marking particle in a plurality of electrographic modules it may be advantageous to alter one or more electrographic process set-points, or operating algorithms, to optimize performance, reliability, and/or image quality of the resultant print. Examples of electrographic processes set-point (or operating algorithms) values that may be controlled in the electrographic printer to alternate predetermined values when printing raised information include, for example: fusing temperature, fusing nip width, fusing nip pressure, imaging voltage on the photoconductive member, toning station transfer voltage, image transfer voltage and image transfer current, and the amount of fusing oil applied during the fusing process. In an electrographic apparatus that makes raised information prints, a special mode of operation may be provided where the predetermined set-points (or control parameters or algorithms) are used when printing the raised information. That is, when the electrographic printing apparatus prints non-raised information images, a first set of set-points/control parameters are utilized. Then, when the electrographic printing apparatus changes mode to print raised information images, a second set of set-points/control parameters are utilized In an electrographic fusing process, the fused toner does not penetrate substrate fibers of the receiver member, but remains entirely above the paper substrate. The fusing step can reduce the height of the toner lay down by approximately one half. As discussed above, parameters for a fusing process that effectively fixes the toner to the receiver member may vary depending on the number of printer modules used for raised printing and the sizes of the marking particles used in applying the print and raised images, as well as the physical and thermal properties of the receiver member. Additionally, parameters such as the one or more sets of fusing parameters for printing raised information can be stored in a memory associated with the printing engine and can be selected and applied based on parameters such as the type of receiver member, the desired post fusing stack height, fusing process speed, the number of print modules used for applying a print image, the sizes and types of toner particles used for applying raised and print images, and the number of print modules used for applying raised images. The parameters may be input manually by an operator, may be determined automatically by sensors associated with the print modules, or a combination of manual entry and parameter sensing may be employed.

Preferably the marking particles used for printing the raised information have a substantially larger general average mean volume weighted diameter than the particles for applying the print information. For example, the marking particles for printing the print information may have a standard general average mean volume of less than 9 μm (e.g. 8 μm), while the marking particles for printing the raised information may have general average mean volume weighted diameter between 12 and 30 μm (e.g. between 21 and 30 μm).

In an example electrographic print engine according to an embodiment of the invention using 8 μm marking particles for applying the print image information, and using 20 μm particles for printing the raised image information, toner lay down coverage of up to 5 mg/cm$^2$ were achieved in areas where the print image and a first and second raised image were applied resulting in post-fusing stack heights of about 50 μm. By way of contrast, when applying several imaging modules using the 8 μm marking particles, lay down coverage of about 0.4 to 0.5 mg/cm$^2$ is typical for each applied layer. Employing enough printing modules to achieve the desired stack heights using 8 μm particles would severely limit the number of available modules for depositing color toners, reducing the achievable color gamut for the final image.

On the other hand, by employing multiple print modules using large non-marking particles to apply raised print images, increased post-fusing stack heights can be achieved using the available print modules for a printing engine. For example, by using four or five modules to apply raised printing images using the larger, non-marking particles, fixed stack heights of 100 μm and greater are possible using electrographic printing.

In the examples described above, the larger sized toner particles for printing raised images have been described as non-pigmented, non-marking particles. The invention may also be practiced with larger sized pigmented particles being used to provide the raised images. For example, raised text of a particular color may be applied using the apparatus described by replacing one or more of the larger sized non-marking particles with larger sized, pigmented, marking toner particles.

Further, in the examples described above, each module for printing a raised image employed toner particles having the same volume average diameter. The invention is not limited to being practiced in this fashion. The plurality of print modules used for applying raised images may employ toner particles having differing sizes provided that the volume average diameter employed by each of the print modules is substantially larger than the standard sized particles. For example, when applying two raised images to a receiver member, the toner particles for printing the first raised image may be substantially larger than the toner particles for printing the second raised image.

Figure 6:
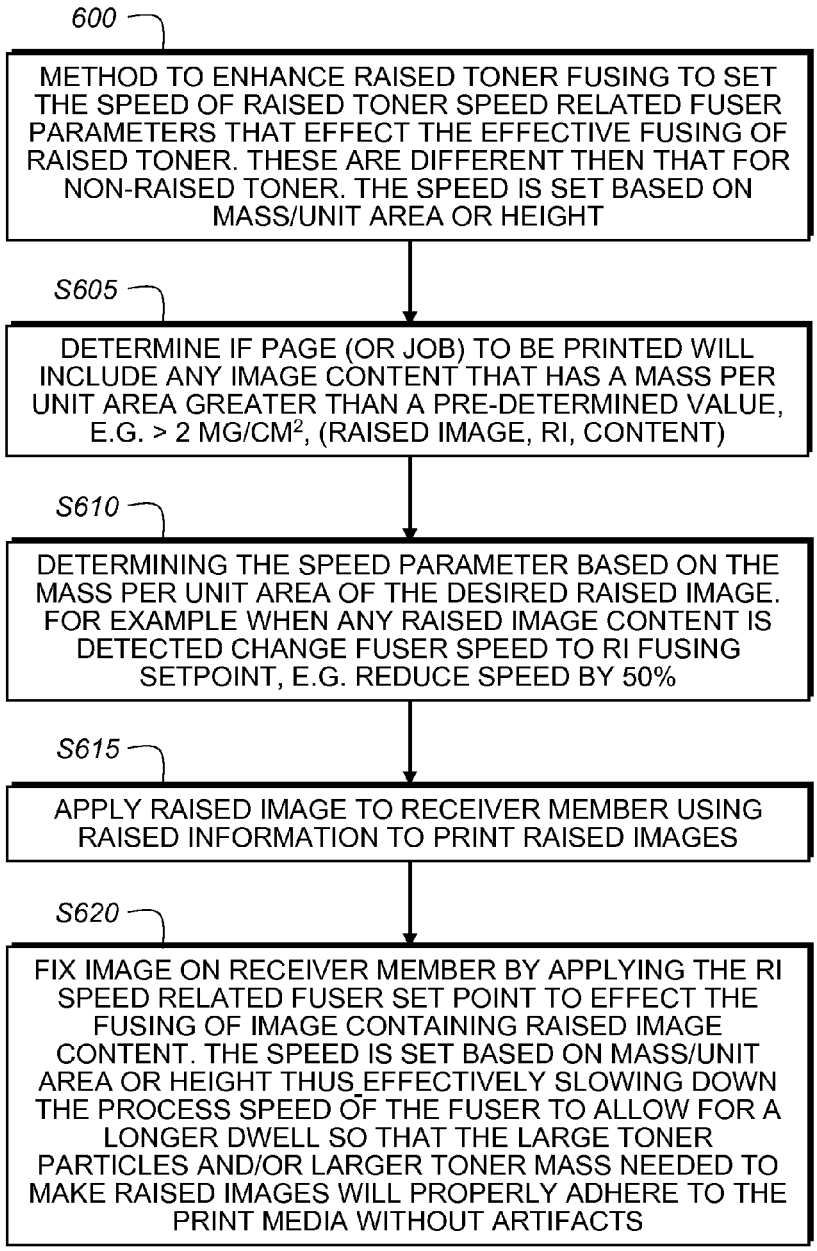
FIGS. 6-8 are flow charts illustrating various embodiments of processes in accordance with the present invention.

An enhanced fusing method for applying raised printing to a receiver member in an electrographic printer that includes slowing down the process speed of the fuser to allow for a longer dwell so that the large toner particles and/or toner mass needed to make raised image will properly adhere to the print media without artifacts is described with reference to FIG. 6. The method uses the apparatus illustrated in FIGS. 1 and 2 and includes steps for exploiting the capabilities of the electrophotographic printer. This method can be implemented with one or more controllers. The method includes control of the one or more speed related fuser parameters that effect the effective fusing of raised toner. These setpoints are different than those used to print images that do not include raised toner, sometimes referred to as non-raised toner or non-raised toner images or prints.

For example, when raised print is used then the speed of the receiver can be set based on a mass/unit area or height related value for that parameter. This in one embodiment, results in effectively slowing down the process speed of the fuser to allow for a longer dwell so that the large toner particles and/or toner mass needed to make raised image will properly adhere to the print media without artifacts. In one embodiment of this method, a speed switching technique is used to slow down the process speed of the fuser (and the EP process in some embodiments) so that the raised image is properly fused on a wide range of paper types. This embodiment can use a look up table (LUT) or separate memory device can be used to implement the automatic speed switches as needed.

The electrographic printing method 600 begins at step S605 in which set points of the electrographic print engine are set up for printing raised information. In particular, and as described above, set points for the fuser may be adjusted so that the printing on the receiver member will be properly fixed. In addition, process speed for moving the receiver members through the print engine may be set differently than for a process in which raised printing will not be applied. In one embodiment S605-determines if page (or job) to be printed will include any image content that has a mass per unit area greater than a pre-determined value, e.g. >2 mg/cm2, (raised image, RI, content).

Process 600 continues at step S610 in which parameters and set points for applying the print image and fusing are applied. For example, the imaging voltage, the toning voltage, magnetic brush operating parameters, the image transfer voltage and the image transfer current may be set as appropriate for applying developer using standard sized marking particles. These parameters and set points are applied to those modules for applying the print image. Specifically in one embodiment S610 the determining step determines the speed parameter based on the mass per unit area of the desired raised image. For example when raised image content is detected change fuser speed to raised ink or toner (RI) fusing setpoint, e.g. reduce speed by 50%). Process 600 continues at step S615 in which the print image, including a raised image, is applied to the receiver member using raised information to print raised images.

Following the application of the print image, the parameters, values, and set points for applying raised images are established at step S620, including both fusing and non-fusing related parameters. Non-fusing parameters, for example, include imaging voltage, a toning station voltage, magnetic brush operating parameters, an image transfer voltage as well as paper, intermediate and photoconductor speeds and an image transfer current. Some fusing related parameters include, for example, temperature, pressure, nip width, and speeds of the fusing related members such as the fuser member related speeds. The fuser members can include fuser rollers, fuser belts, and proper transport device speeds.

In one embodiment, the marking particles for printing the raised images are typically substantially larger than those for printing the print image, and some of the electrographic parameters and set points are applied to those modules for applying the raised images may be different than those applied to the modules for applying the print image. For example, the printing engine 100 can form a multi-colored print image on the receiver member 200 using print modules 10B, 10C, 10E, and 10F. Printing module 10A can be used to apply a first raised image using a first larger than standard sized toner particle (e.g. a 20 μm marking particle), and printing module 10E can be used to apply a second raised printing image using a second larger than standard sized toner particle (e.g. a 30 μm marking particle).

In particular in S620, the printer system fixes the image on receiver member by applying the RI speed related fuser set point to effect the fusing of image containing raised image content. The speed is set based on mass/unit area or height thus effectively slowing down the process speed of the fuser to allow for a longer dwell so that the large toner particles and/or larger toner mass needed to make raised images will properly adhere to the print media without artifacts.

Also process 600 can continue so that the first raised image is applied to the receiver member in first selected areas of a receiver member and a second raised image is applied in second selected areas of a receiver member. The first selected areas may be the same as the second selected areas. The first selected areas and the second selected areas may overlap with all or some portion of the print image. Alternatively, the print image and the raised images may occupy separate areas of a receiver member. Following application of the first and second raised image, the print image and the raised images are fused on the receiver member to fix the combined image. Additional process steps can be added to process 600 when more than 6 print modules are used as described in co-pending application U.S. Ser. No. 12/404,485 which hereby incorporated by reference.

Figure 7:
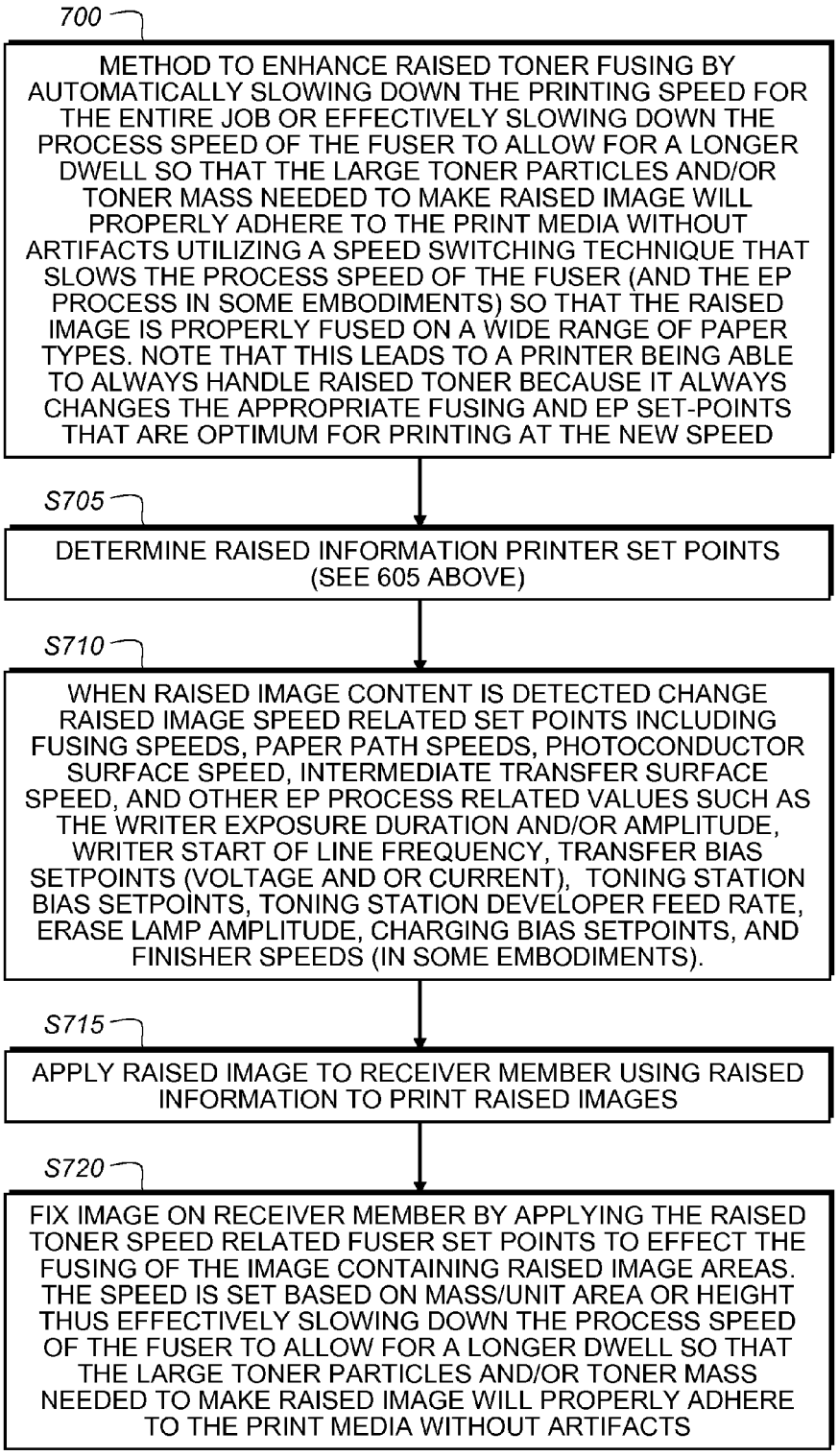

FIG. 7 describes another embodiment of the enhanced fuser system for raised print. In this embodiment the fusing enhancement includes using the printer to detect the presence of a raised toner or dry-ink station containing toner that enables raised printing it changes modes so that it prints at a slower speed. This is automated and can be used in conjunction to the other methods described herein. This leads to a printer being able to always handle raised toner because it always changes the appropriate fusing and EP set-points that are optimum for printing at the new speed. First step S705 determines the raised toner setpoints as described above in conjunction to step 605.

Then in step S710, when the raised image content is detected then the raised image speed related set points are changed including fusing speeds, paper path speeds, photoconductor surface speed, intermediate transfer surface speed, and other EP process related values such as the writer exposure duration and/or amplitude, writer start of line frequency, transfer bias setpoints (voltage and or current), toning station bias setpoints, toning station developer feed rate, erase lamp amplitude, charging bias setpoints, and finisher speeds when needed.

The raised image is applied in step S715 similarly to step S615 described above and the image fused in step S720, which fixes the image on the receiver member by applying the raised toner speed related fuser set points to effect the fusing of the image containing raised image areas. The speed is set based on mass/unit area or height thus effectively slowing down the process speed of the fuser to allow for a longer dwell so that the large toner particles and/or toner mass needed to make raised image will properly adhere to the print media without artifacts.

Figure 8:
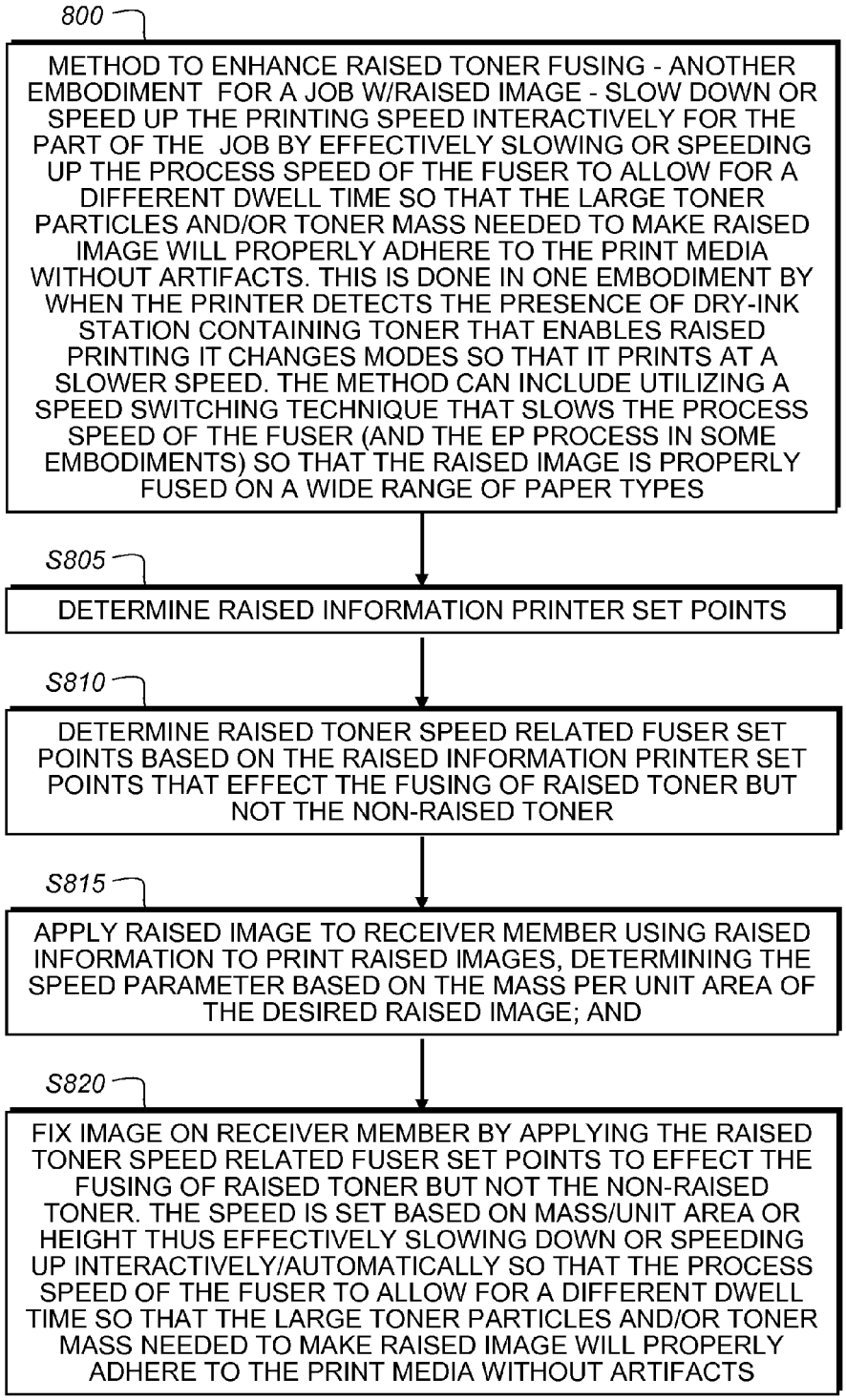

Another electrographic printing method for applying raised printing to a receiver member will be described with reference to FIG. 8. The electrographic printing method can be performed using the apparatus Once again this method can utilizing a speed switching technique that slows the process speed of the fuser (and the EP process in some embodiments) so that the raised image is properly fused on a wide range of paper types. The electrographic printing method 800 begins at step S805 in which set points of the electrographic print engine are set up for printing raised information. In particular, and as described above, set points for the fuser may be adjusted so that the printing on the receiver member will be properly fixed. In addition, process speed for moving the receiver members through the print engine may be set differently than for a process in which raised printing will not be applied. In one embodiment S805-determines if page (or job) to be printed will include any image content that has a mass per unit area greater than a pre-determined value, e.g. >2 mg/cm2, (raised image, RI, content).

The process continues at step S810 when the required raised toner speed and additional related fuser set points are determined based on the Raised Information Printer set points that effect the fusing of raised toner. Then, in step S815 the raised image is applied to the receiver member using raised information to print raised images, determining the speed parameter based on the mass per unit area of the desired raised image.

Finally in step S820 the image is fixed or fused on the receiver member by applying the raised toner speed related fuser set points to effect the fusing of raised toner but not the non-raised toner. The speed is set based on mass/unit area or height thus effectively slowing down or speeding up interactively/automatically so that the process speed of the fuser to allow for a different dwell time so that the large toner particles and/or toner mass needed to make raised image will properly adhere to the print media without artifacts.

The invention has been described in detail with particular reference to certain preferred embodiments thereof, but it will be understood that variations and modifications can be effected within the spirit and scope of the invention.

PARTS LIST

10 electrographic printing modules
30 fusing assembly
31 heated fusing roller
32 Fuser pressure roller
100 electrographic printer engine
105 photoconductive drum
106 exposing unit
107 development station
108 charging module
110 intermediate transfer member drum
115 second transfer nip
117 first transfer nip
118 rotating lower transfer drum
121 uniform electrostatic charge meter
122 post exposure charge meter
123 logic and control unit
124 module logic and control component
200 receiver member
210 transport belt
300 print image
302 first raised image
304 second raised image

What is claimed is:

1. An electrographic printing method for forming raised information on a receiver member, the method comprising:

forming a print image having a raised image electrographically on first raised image area of the print image on the receiver according to electronhotographic process non-fusing setpoints;

setting a raised fusing parameter to a raised fusing value for fixing the print image with the raised images made using the non-fusing setpoints to the receiver member that is distinct from a fusing parameter value for fixing a print image without the raised images transporting the receiver member through a fuser assembly controlled by a fuser assembly controller for setting raised fusing parameters based on a determination by the controller;

adjusting the transport speed of the receiver member through the fuser assembly to compensate for the first raised image areas using the raised fusing value; and fixing the print image, including the raised images, to the receiver member using a fuser employing the raised fusing parameter value.

2. The method according to claim 1, the raised fusing value further used to control the speed of the receiver member transported through said fuser assembly based on stored parameters, the parameters required for fusing particular types of receiver members under various desired conditions based on information from the image and the receiver member type.

3. The method according to claim 1, further comprising slowing down fuser with the paper path as well as the changing the pressure and/or temperature settings in the printer.

4. The method according to claim 3, further comprising adjusting the intermediate member speed.

5. The method according to claim 1, wherein the raised image is formed on the receiver member using one of a mass/unit area and/or height that is more than that used for non-raised print using for that image.

6. The method according to claim 5, wherein the mass/unit area and/or height used to make the raised image is formed using first toner particles having an average diameter substantially larger than a standard sized marking particles used for non-raised print images.

7. The method according to claim 1, wherein the mass per unit area of the raised image is substantially larger than the mass per unit area of the non-raised image.

8. The method according to claim 1, wherein the raised area on a portion of the receiver member has a mass per unit area of at least 2.0 mg/cm2 on the portion of the receiver member.

9. The method according to claim 1, wherein the raised area on a portion of the receiver member has a mass per unit area of at least 4.0 mg/cm2 on the portion of the receiver member.

10. The method according to claim 1, wherein the raised area on a portion of the receiver member has a mass per unit area of at least 5.5 mg/cm2 on the portion of the receiver member.

11. The method according to claim 1, wherein forming a print image electrographically on a receiver member comprises forming a print image using a single print module.

12. The method according to claim 1, wherein an algorithm for generating image information for applying the print image in an area of the receiver member overlapped by at least one of the first raised image and the second raised image is different from an algorithm for generating image information for generating the print image in an area of the receiver member not overlapped by the first raised image and not overlapped by the second raised image.

13. The method according to claim 1, further comprising forming a second raised image electrographically on second selected areas of the print image on the receiver member using toner particles having a volume average diameter substantially larger than volume average diameter of the standard sized marking particles.

14. An electrographic printer for forming raised information on a receiver member comprising:

a fuser assembly having a pair of rollers in nip relation to apply heat and/or pressure to a receiver member bearing a raised image to fuse the raised image to such receiver member using a raised fusing parameter adjusted to a raised fusing value for fusing the print image with the raised images to the receiver member that is distinct from a fusing parameter value for fusing a print image without the raised images;

a motor for rotating said pair of rollers to provide a drive in the roller nip to transport the receiver member through the fuser assembly;

a mechanism for controlling the speed of the receiver member transported through the fuser assembly, the speed control mechanism comprising:

an input device for storing parameters required for fusing particular types of receiver members under various desired conditions ;

a device for determining fuser control parameters, including raised fusing parameters, based on information from the input device and selection of a particular receiver member type and non-fusing setpoints used to form the print image;

and a fuser assembly controller for setting raised fusing parameters to raised fusing values based on the determination by said determining device, and for adjusting the motor for rotating the pair of rollers to set the transport speed of the receiver member through the fuser assembly to compensate for the raised image.

15. The apparatus of claim 14 wherein the raised fusing parameter is based on nip load.

16. The apparatus of claim 14 wherein the raised fusing parameter is based on nip width.

17. The apparatus of claim 14 wherein the raised fusing parameter is based on one of a mass/unit area and/or height that is more than that used for non-raised print using for that image.

18. The apparatus of claim 14 wherein the input device and the determining device are integral with the fuser assembly controller.

19. An electrographic printing method for forming raised information, the method comprising:

receiving a receiver member;

selectively applying first standard size marking particles onto the receiving member by a first print module;

selectively applying first larger sized toner particles having a volume average diameter larger than the standard size marking particles onto the receiving member by a second print module;

selectively applying second larger sized toner particles having a volume average diameter substantially larger than the standard size marking particles onto the receiving member by a third print module according to electrophotographic non-fusing setpoints; and setting a raised fusing parameter for fixing the print image and the raised images to the receiver member to a changed value distinct from a value for fixing a print image without the raised images according to the electrophotographic non-fusing setpoints, and fixing the print image and the raised images to the receiver member using a fuser employing the changed parameter value.

20. The method according to claim 13, wherein the standard size marking particles have a volume average diameter of less than 9μm, and the first and second larger sized toner particles have a volume average diameter of greater than 14μm.

* * * * *